US007543553B2

(12) United States Patent
Watanabe

(10) Patent No.: US 7,543,553 B2
(45) Date of Patent: Jun. 9, 2009

(54) CIRCULATING FLUIDIZED BED BOILER

(75) Inventor: Shuzo Watanabe, Ichikawa (JP)

(73) Assignee: Ishikawajima-Harima Heavy Industries Co., Ltd. (JP)

( * ) Notice: Subject to any disclaimer, the term of this patent is extended or adjusted under 35 U.S.C. 154(b) by 858 days.

(21) Appl. No.: 10/980,916

(22) Filed: Nov. 4, 2004

(65) Prior Publication Data

US 2005/0064357 A1 Mar. 24, 2005

Related U.S. Application Data

(63) Continuation of application No. 10/291,896, filed on Nov. 8, 2002, now abandoned.

(30) Foreign Application Priority Data

Nov. 12, 2001 (JP) ..... 2001-346696

(51) Int. Cl.
*F27B 15/08* (2006.01)

(52) U.S. Cl. ..... 122/4 D; 110/245; 432/58

(58) Field of Classification Search ..... 122/4 D; 110/245; 432/58; 165/104.16
See application file for complete search history.

(56) References Cited

U.S. PATENT DOCUMENTS

| | | | | |
|---|---|---|---|---|
| 5,140,950 | A | 8/1992 | Abdulally | |
| 5,141,708 | A | 8/1992 | Campbell, Jr. et al. | |
| 5,526,775 | A * | 6/1996 | Hyppanen | 122/235.11 |
| 5,570,645 | A * | 11/1996 | Garcia-Mallol | 110/245 |
| 6,264,465 | B1 * | 7/2001 | Ishida | 432/58 |
| 6,269,778 | B1 * | 8/2001 | Anderson et al. | 122/4 D |
| 6,293,781 | B1 * | 9/2001 | Hyppanen | 431/7 |
| 6,336,500 | B2 * | 1/2002 | Hyppanen | 165/96 |

FOREIGN PATENT DOCUMENTS

| | | |
|---|---|---|
| CN | 2376579 Y | 5/2000 |
| JP | 01-244291 | 9/1989 |
| JP | 05-052305 | 3/1993 |
| JP | 5-52307 | 3/1993 |
| JP | 07-180805 | 7/1995 |
| JP | 11-512814 | 11/1999 |
| JP | 2001-248804 | 9/2001 |

(Continued)

OTHER PUBLICATIONS

Untranslated Office Action issued by Korean Patent Office on Oct. 2, 2004 in connection with corresponding Korean application No. 10-2002-0067353.

(Continued)

*Primary Examiner*—Jiping Lu
(74) *Attorney, Agent, or Firm*—Ostrolenk, Faber, Gerb & Soffen, LLP

(57) ABSTRACT

A circulating fluidized bed boiler has reduced corrosion in the exchanging tube in an external heat exchanger. The circulating fluidized bed boiler has a furnace which combusts a fuel which is fluidized together with a bed material, a cyclone dust collector into which an flue gas which is generated by the combustion in the furnace is introduced and which catches particles in the flue gas, a separation loop, in a seal box, which separates corrosive components from the particles so as not to introduce the corrosive components to the external heat exchanger which is arranged downstream of the seal box.

2 Claims, 5 Drawing Sheets

FOREIGN PATENT DOCUMENTS

| | | |
|---|---|---|
| WO | WO 97/46829 | 12/1997 |
| WO | WO 00/45091 | 8/2000 |

OTHER PUBLICATIONS

Letter from Japanese associate dated Oct. 28, 2004 with summarization of Korean Office Action.

Office Action issued by Chinese State Intellectual Property Office on Jul. 30, 2004 in connection with corresponding Chinese application No. 0213990.5.

English translation of Chinese Office Action dated Jul. 30, 2004.

Letter from Japanese associate dated Oct. 27, 2004 with summarization of Chinese Office Action.

Letter from Japanese associate dated Aug. 18, 2005 with summarization of disclosure.

English translation of Office Action issued by Japanese Patent Office on Jun. 27, 2005 in connection with corresponding Japanese application No. 2002-328357.

Untranslated Office Action issued by Japanese Patent Office on Jun. 27, 2005 in connection with corresponding Japanese application No. 2002-328357.

*Fluidized Bed Combustion*: Large Size Power Plants Working According to the Atmospheric and Pressurized CFB Technology, Ludolf Plass,et.al., ASME 1991, pp. 175-181.

Search Report Transmittal Notice from European Patent Office dated Feb. 9, 2004 related to application No. EPP86941.

Office Action issued by the Japanese Patent Office on Jul. 10, 2007 in connection with corresponding Japanese Patent Application No.:2002-328357.

Translation of the Office Action issued by the Japanese Patent Office on Jul. 10, 2007 in connection with corresponding Japanese Patent Application No.:2002-328357.

* cited by examiner (PRIOR ART)

CIRCULATING FLUIDIZED BED BOILER

CROSS-REFERENCE TO RELATED APPLICATIONS

This is a continuation of U.S. patent application Ser. No. 10/291,896, filed Nov. 8, 2002 in the name Shuzo WATANABE and entitled CIRCULATING FLUIDIZED BED BOILER.

BACKGROUND OF THE INVENTION

1. Field of the Invention

The invention relates to a circulating fluidized bed boiler for combusting wastes or solid fuels which contain corrosive components such as chlorine, by feeding the wastes or the solid fuels together into circulating fluidized bed in a furnace.

2. Background Art

FIG. 5 shows a construction of a conventional circulating fluidized bed boiler. Generally, the circulating fluidized bed boiler comprises a furnace 2, a cyclone dust collector 3 into which flue gas which is generated by the combustion in the furnace 2 flows and which catches particles which are contained in the flue gas, a seal box 4 into which the particles which are caught by the cyclone dust collector 3 flow and external heat exchanger 6 which performs heat exchange between the circulating particles and in-bed tubes in the heat exchanger 6.

The furnace 2 consists of a water cooled furnace wall 2*a* and an air distribution nozzle 7 which introduces fluidizing air A to the furnace 2 so as to create a fluidizing condition in the furnace 2 is arranged in a bottom part of the furnace 2. The cyclone dust collector 3 is connected with an upper part of the furnace 2. An upper part of the cyclone dust collector 3 is connected with the heat recovery area 8 into which flue gas which is generated by the combustion in the furnace 2 flows, and a bottom part of the cyclone dust collector 3 is connected with the seal box 4 into which the caught particles flows.

A super heater and economizer etc. contain in the heat recovery area 8.

An air box 10 is arranged in a bottom of the seal box 4 so as to intake upward fluidizing air B through an air distribution plate 9. The particles in the seal box 4 are introduced to the external heat exchanger 6 and are in-bed tube 5 under fluidizing condition.

In the furnace of the above explained circulating fluidized bed boiler, bed materials 11 which comprise ash, sand and limestone etc. are under suspension by the fluidizing condition.

Most of the particles entrained with flue gas escape the furnace 2 and are caught by the cyclone dust collector 3 and are introduced to the seal box 4. The particles thus introduced to the seal box 4 are aerated by the fluidizing air B and are heat exchanged with the in-bed tubes 5 of the external heat exchanger 6 so as to be cooled. The particles are returned to the bottom of the furnace 2 through a duct 12 so as to circulate through the furnace 2.

In the above conventional fluidized bed boiler, corrosion on the high-temperature area of the in-bed tubes 5 tends to occur due to chlorine which is contained in the particles.

This is because the circulating particles contain unburned fuel which contains a chlorine and combusts in the seal box 4 together with the fluidizing air B. The unburned fuel thus combusted in the seal box 4 generates melted salts which contain sulfate and condense so as to adhere to a high temperature area in the heat exchanger 6. Further, a high temperature corrosion by corrosive halogen gas, e.g., chlorine gas, which is generated during the above combustion occurs in the heat exchanger 6.

SUMMARY OF THE INVENTION

The present invention was made in view of the above problems and contributes to the solution of the corrosion problem on the in-bed tubes of the external heat exchanger.

The circulating fluidized bed boiler of the present invention provides a furnace which combusts a fuel which is fluidized together with a bed material, a cyclone dust collector into which an flue gas which is generated by the combustion in the furnace is introduced and which catches particles in the flue gas, a seal box into which most of the particles which are caught by the cyclone dust collector are introduced, an external heat exchanger which is arranged in a downstream side of the seal box. The above fluidized bed boiler further provides a separation loop, in the seal box, upstream of heat exchanger 6, which separates corrosive components from the particles so as not to introduce the corrosive components to the external heat exchanger.

According to the above circulating fluidized bed boiler, the fuel which is fluidized together with the bed material combusts and the particles which are blown upward with the flue gas which is generated by this combustion are caught in the cyclone dust collector and are introduced to the separation loop. The separation loop combusts unburned particles which are contained in the combustible particles by the fluidizing air so as to separate the corrosive components with the particles and the off gas in the seal box is introduced to the furnace through a duct which is arranged above the seal box prior to being introduced to the external heat exchanger; therefore it is possible to solve the corrosion problem on the high temperature metal tube due to melted salts. Because the unburned particles are thus combusted by the separation loop, and an amount of the unburned particles flowing into the external heat exchanger in which the in-bed tube is arranged is minimized, the service life of the in-bed tube is extended.

In another aspect of the present invention, a separation loop comprises a path, such as a duct or a pipe, through which the corrosive components which are generated by the combustion in the separation loop are exhausted out of the seal box.

Because the off gas containing corrosive components is exhausted out of the seal box and is not introduced to the external heat exchanger, an amount of the corrosive gas in which the exchanging tube is exposed is minimized so as to prevent the corrosion in the in-bed tubes and also to extend the service life of the in-bed tubes.

In a further aspect of the present invention, the path is connected with the furnace.

And since the off gas generated in the separation loop is exhausted into the furnace, the amount of corrosive gas is minimized so as to prevent corrosion of the in-bed tube and also to extend the service life of the in-bed tube.

In a further aspect of the present invention, the seal box is separated into a plurality of compartments and one compartment which is arranged upstream of another compartment and in which the separation loop is arranged, and another component which is arranged downstream of one component is connected with the furnace.

Because the other compartment which is arranged in downstream of the one compartment is connected with the furnace, flue gas which is processed by the separation loop is introduced to the furnace.

DESCRIPTION OF THE PREFERRED EMBODIMENTS

Hereinafter, embodiments of the present invention will be explained with reference to the figures. However the invention is not specifically limited thereto.

Figure 1:
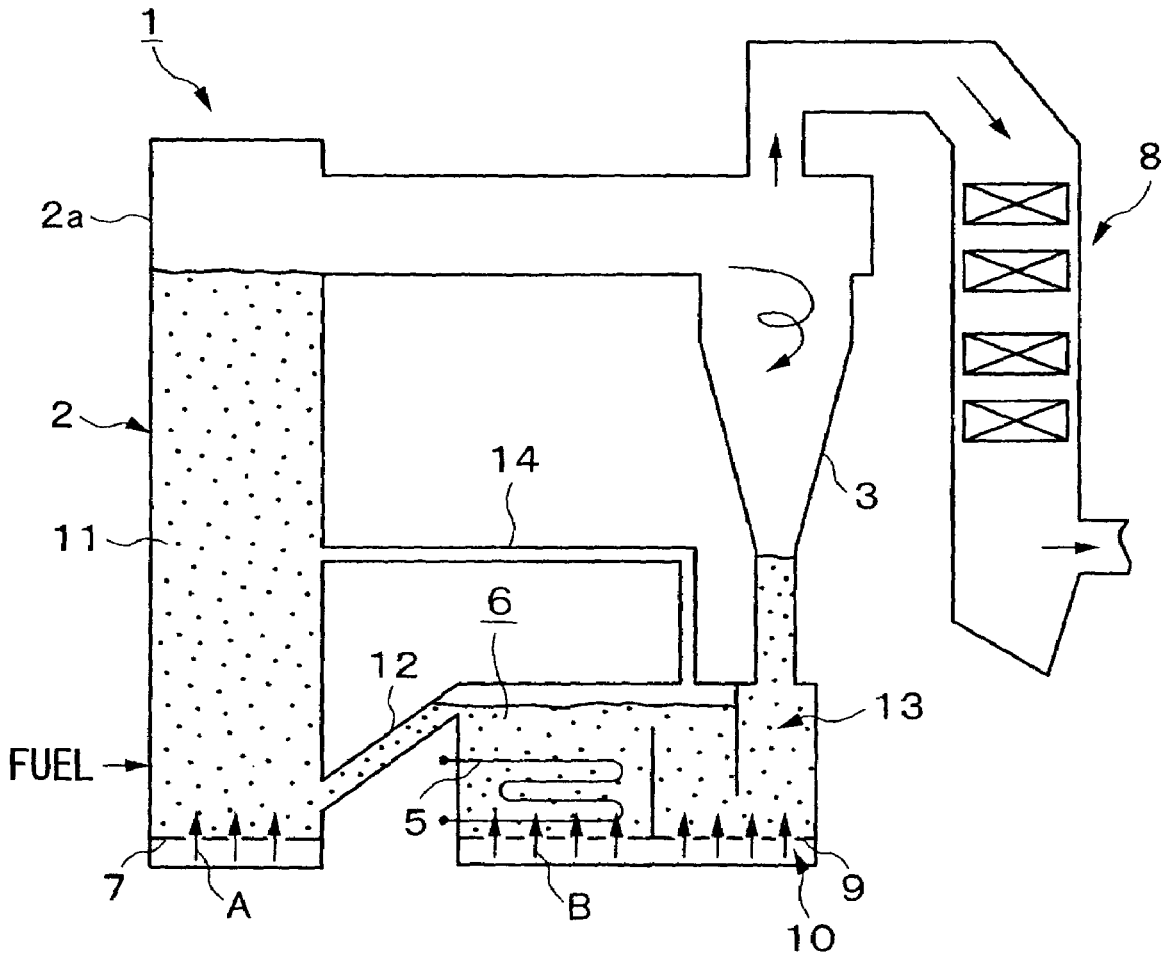
FIG. 1 is a schematic view of the first embodiment of the fluidized bed boiler of the present invention.
Figure 5:
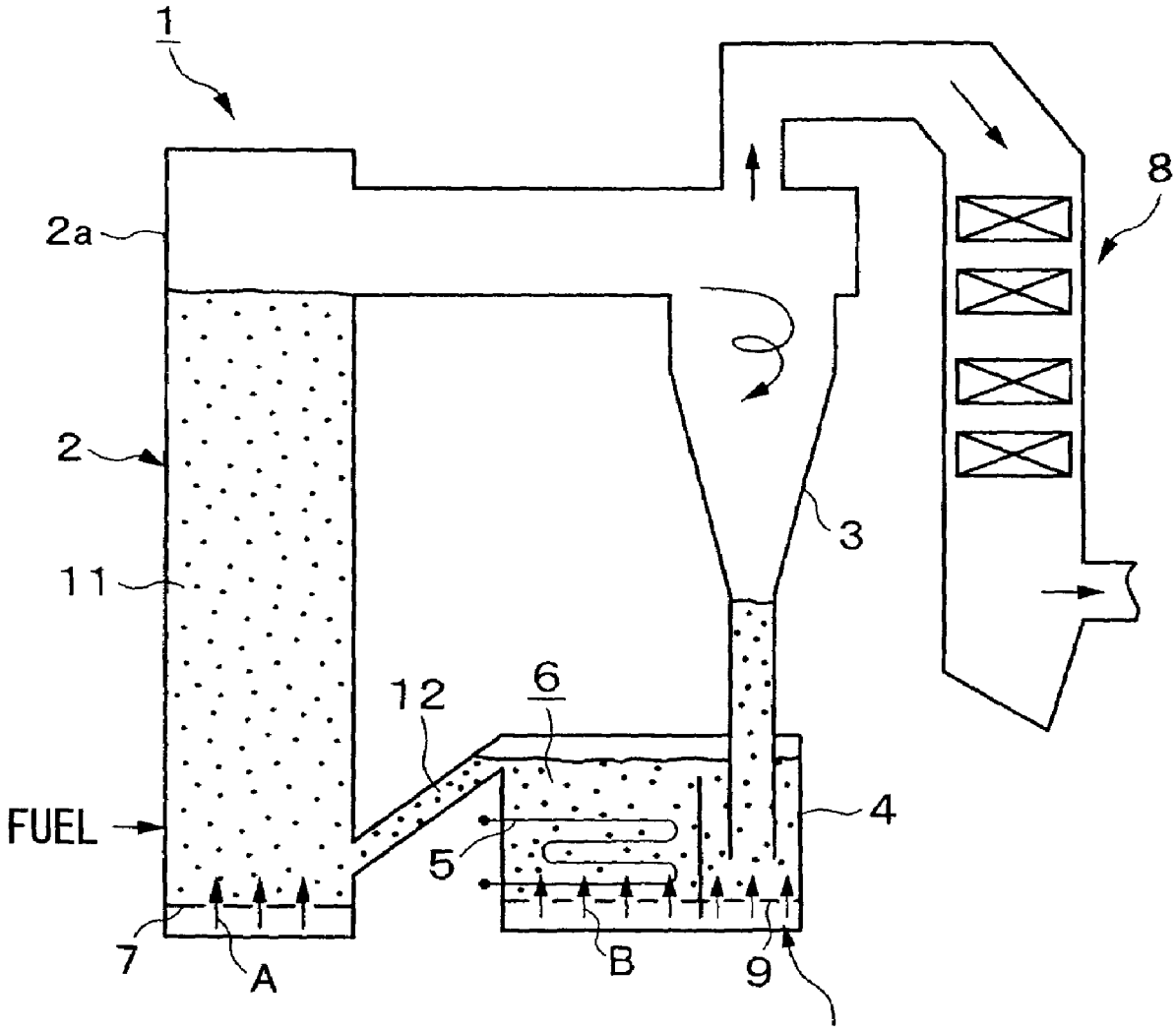
FIG. 5 is a schematic view of a conventional fluidized bed boiler.

The first embodiment will be explained in reference with FIG. 1. FIG. 1 shows a schematic view of the first embodiment, and in FIG. 1, components which are similar to the components of the conventional fluidized bed boiler in FIG. 5 are indicated by numerals corresponding to those in FIG. 5.

The fluidized bed boiler 1 of the first embodiment comprises a furnace 2, a cyclone dust collector 3 into which an flue gas generated by a combustion in the furnace 2 and which catches particles which are contained in the flue gas, a separation loop into which the particles which are caught by the cyclone dust collector 3 are introduced, and an external heat exchanger 6 which is integrated with the separation loop.

The furnace 2 comprises the water cooled furnace wall 2*a* in a bottom part of which the air distribution nozzle 7, which introduces fluidizing air A into the furnace 2, is arranged. The cyclone dust collector 3 is connected with an upper part of the furnace 2 and an upper part of the cyclone dust collector 3 is connected with a heat recovery area 8 into which the flue gas is generated by the combustion in the furnace 2. A bottom part of the cyclone dust collector 3 is connected with a separation loop 13 into which the particles which are caught by the cyclone dust collector 3 are introduced. A heat exchanging part is arranged in the heat recovery area 8.

An air box 10 which blows a fluidizing air B upward through an air distribution plate 9 is arranged in a bottom part of the external heat exchanger 6 and the separation loop 13. The external heat exchanger 6 produces a fluidized state and performs heat exchanging between the particles and the in-bed tubes 5.

The features of the first embodiment are that the fluidized bed boiler comprises the separation loop 13, into which the particles which are caught by the cyclone dust collector 3 are primarily introduced, and the heat exchanger 6, in which the in-bed tubes 5 are arranged, the circulating particles actively combust in the separation loop 13 and the off gas which is generated by the above combustion is introduced to the furnace 2 through a duct 14 for a corrosive gas. The particles which are processed by the separation loop 13 are introduced to the external heat exchanger 6 so as to exchange heat with the in-bed tubes 5 and are returned to the bottom of the furnace 2.

Next, the performances of the first embodiment will be explained.

Fuels which are supplied on the air distribution nozzle 7 are fluidized together with the bed materials 11 such as sand, ash and limestone by the fluidizing air A which is supplied by the air distribution nozzle and combust so as to generate steam for supply a steam turbine for a generator, etc. (not shown in the figures).

The particles which are blown upward by the flue gas which is generated by the combustion in the furnace 2 are caught by the cyclone dust collector 3 and introduced to the separation loop 13. The particles thus introduced to the separation loop 13 begin to flow due to the fluidizing air which is supplied by the air box 10.

The non-combusted fuels which are contained in the particles combust in the separation loop 13 and generate off gas which contains molten salts and corrosive halogens, etc. The off gas is directed to the upper part of the separation loop 13 and is introduced to the furnace 2 through the duct 14 for the off gas.

The particles are heat exchanged with the in-bed tube 5 of the external heat exchanger 6 and are returned to the bottom part of the furnace 2 so as to circulate.

Because the non-combusted fuel in the particles thus combusts in the separation loop 13 and the unburned fuel does not flow into the heat exchanger 6 in which the in bed tubes 5 are arranged, it is possible to reduce the amount of the off gas which contains corrosive materials and is introduced to the heat exchanger 6.

Because the off gas which is generated in the separation loop 13 is exhausted into the furnace 2 through the duct 14 for corrosive gas, it is possible to prevent the corrosion of the in-bed tubes 5 by reducing an amount of the off gas flowing into the heat exchanger 6.

Figure 2:
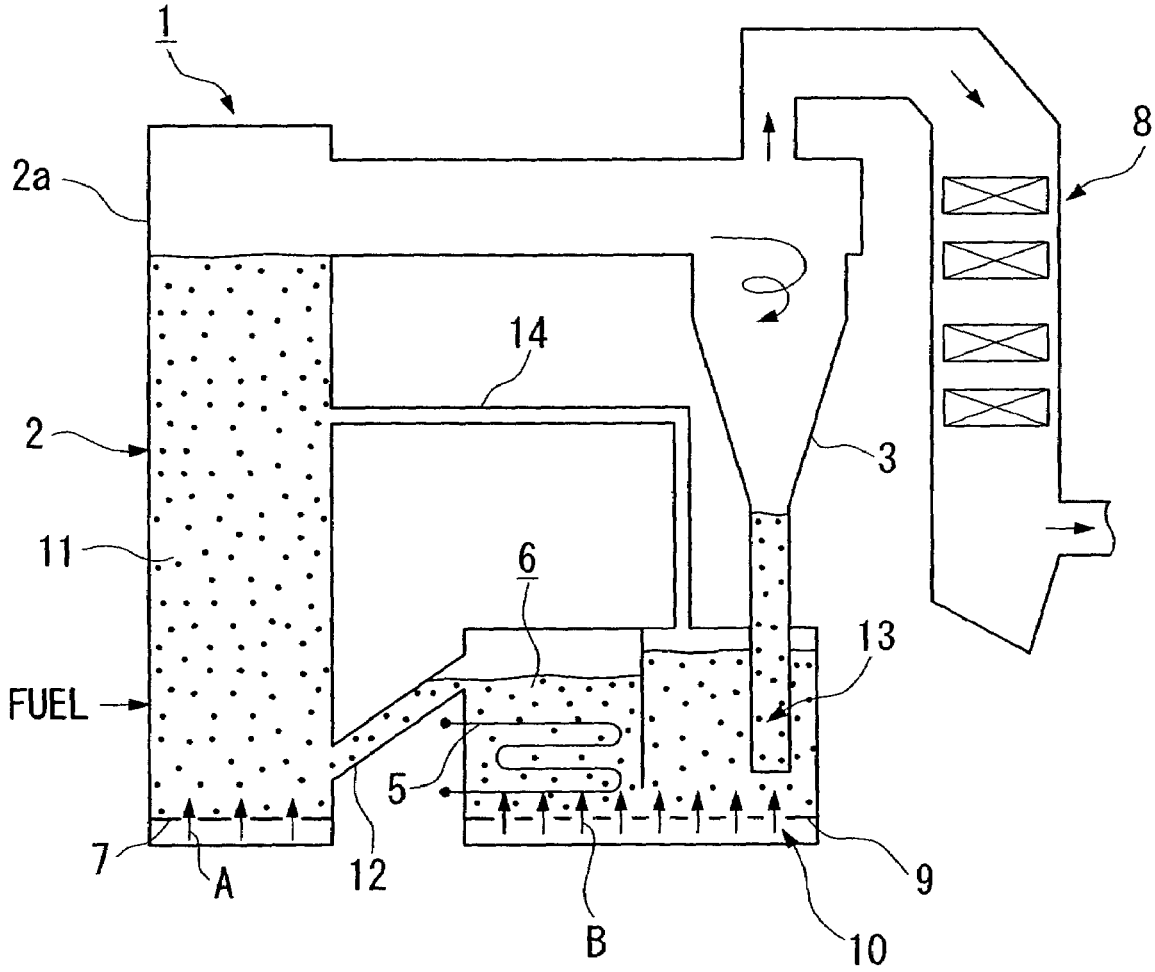
FIG. 2 is a schematic view of the second embodiment of the fluidized bed boiler of the present invention.

FIG. 2 shows a second embodiment of the present invention. In FIG. 2, components which are similar to the components of FIG. 1 are indicated by the same numerals as in FIG. 1.

The common construction of the fluidized bed boiler 1 of the second embodiment is similar to that of the first embodiment in FIG. 1. In this embodiment, the heat exchanger 6 is connected with the seal box 4 at a bottom part in order to introduce the particles.

Figure 3:
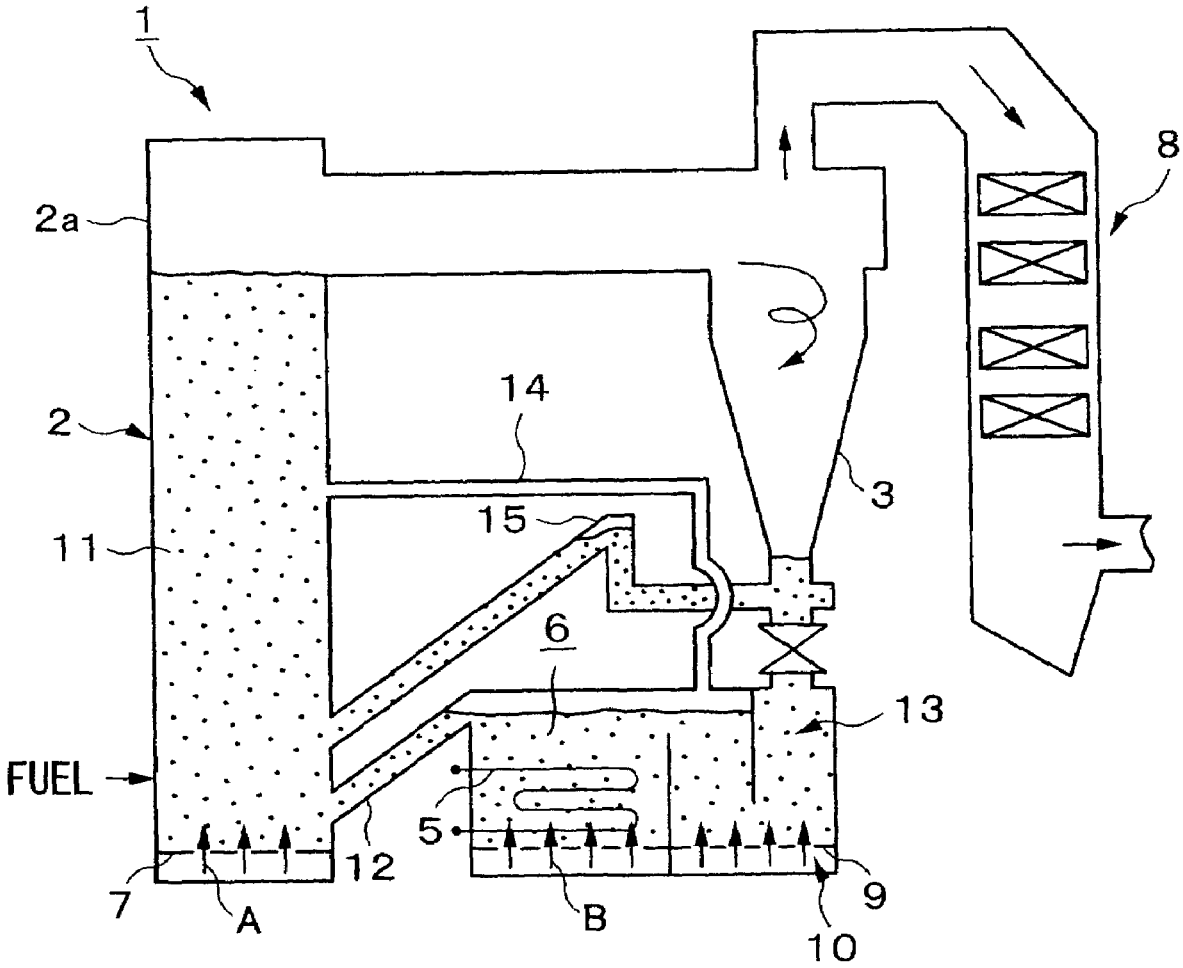
FIG. 3 is a schematic view of the third embodiment of the fluidized bed boiler of the present invention.

FIG. 3 shows a third embodiment of the present invention. In FIG. 3, components which are similar to the components of FIG. 1 are indicated by the same numerals as in FIG. 1.

The common construction of the fluidized bed boiler 1 of the third embodiment is similar to that of the first embodiment in FIG. 1. The aspect of the third embodiment is that a sealing loop 15, through which the circulating particles return to the bottom of the furnace 2, is arranged in a branch path which branches from the bottom of the cyclone dust collector 3.

The fluidized bed boiler 1 of the third embodiment can control the temperature of the furnace 2 during the combustion by adjusting the ratio of the amount of particles which pass through the sealing loop 15 and return to the furnace 2 to another particles which pass the external heat exchanger 6 and return to the furnace 2. Other actions of the fluidized bed boiler of the third embodiment is similar to those of the first embodiment.

Figure 4:
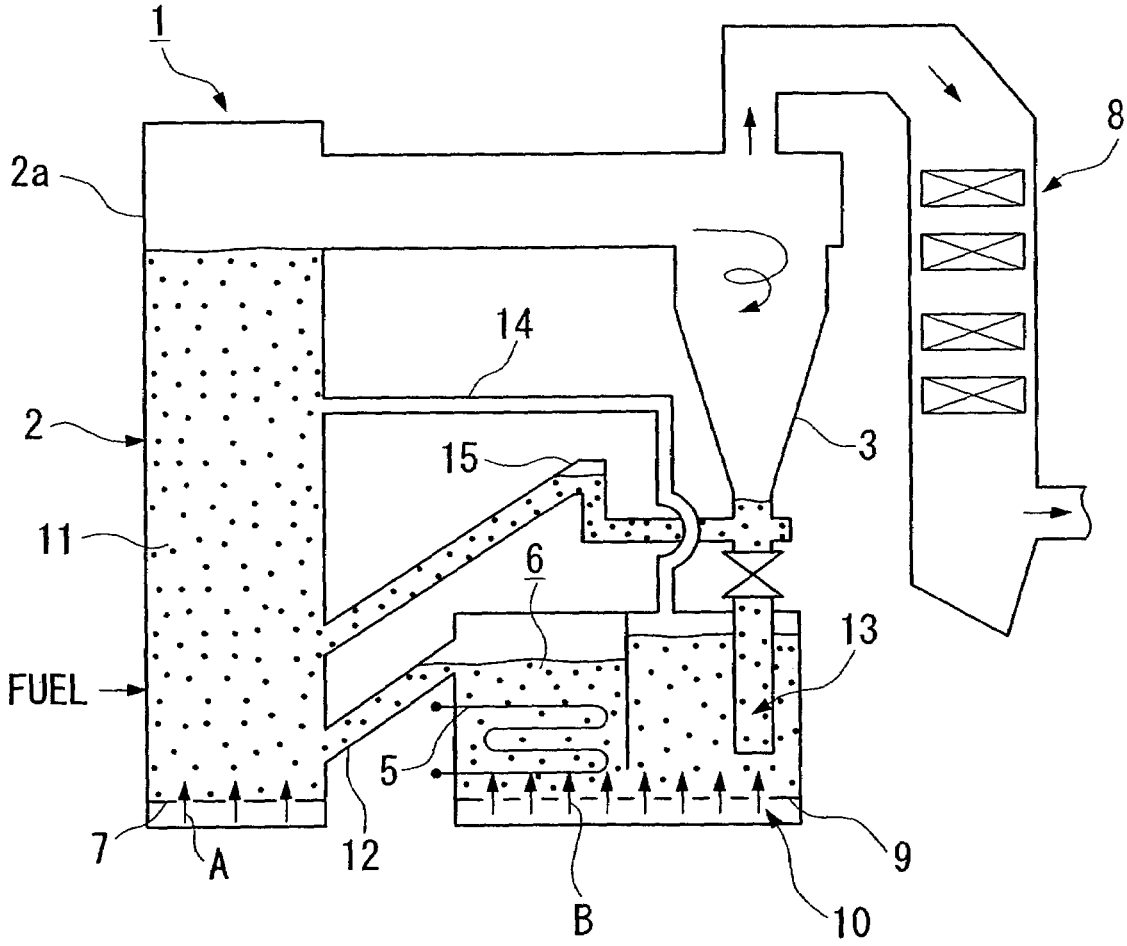
FIG. 4 is a schematic view of the fourth embodiment of the fluidized bed boiler of the present invention.

FIG. 4 shows a fourth embodiment of the present invention. In FIG. 4, components which are similar to the components of FIG. 1 are indicated by the same numerals as in FIG. 1.

The common construction of the fluidized bed boiler 1 of the fourth embodiment is similar to that of the third embodiment in FIG. 3. In this embodiment, the heat exchanger 6 is connected with the seal box 4 at a bottom part in order to introduce the particles.

The present invention is not limited in the above embodiments, and variations thereof are possible. For instance, a separation loop 13 which consists of multiple compartments can be arranged in one seal box 4, in addition to the separation loops 13 of the above embodiments which consist of single compartment.

What is claimed is:

1. A circulating fluidized bed boiler comprising:

a furnace which combusts a fuel which is fluidized together with a bed material, a cyclone dust collector into which flue gas which is generated by a combustion in the furnace is introduced and which catches particles;

a seal box into which the particles which are caught by the cyclone dust collector are introduced, an external heat exchanger which is arranged downstream of the seal box, a separation loop which separates corrosive components from said particles so as not to introduce the corrosive components to said external heat exchanger in said seal box and said separation loop comprising a duct path having an inlet through which said corrosive components which are originated by the combustion of said particles and air are carried to said furnace; and a duct which connects an upper portion of the external heat exchanger with the furnace and through which the particles are returned to the furnace, wherein said seal box is separated into a plurality of compartments, one of which is located most downstream and which contains said external heat exchanger, and including upstream of said most downstream compartment, at least two compartments with the more upstream of the two compartments receiving the particles from the dust collector and an intermediate compartment that is vertically aligned with the inlet into the duct path of the separation loop.

2. A circulating fluidized bed boiler according to claim 1, wherein said separation loop is partially arranged in a bottom part of said cyclone dust collector.

* * * * *